US005141095A

United States Patent [19]

Kamp

[11] Patent Number: 5,141,095

[45] Date of Patent: Aug. 25, 1992

[54] PACKAGE TRANSPORT DEVICE

[75] Inventor: Heinz Kamp, Kempen, Fed. Rep. of Germany

[73] Assignee: Palitex Project Company GmbH, Krefeld, Fed. Rep. of Germany

[21] Appl. No.: 691,718

[22] Filed: Apr. 26, 1991

[30] Foreign Application Priority Data

Apr. 28, 1990 [DE] Fed. Rep. of Germany ..... 4013793

[51] Int. Cl.[5] ..... B65G 25/00

[52] U.S. Cl. ..... 198/409; 198/463.3; 198/861.5

[58] Field of Search ..... 198/409, 414, 861.5, 198/365, 457, 861.6, 463.3

[56] References Cited

U.S. PATENT DOCUMENTS

| | | | |
|---|---|---|---|
| 3,275,135 | 9/1966 | Niese | 198/861.5 X |
| 3,348,678 | 10/1967 | Flowers | 198/861.5 X |
| 3,687,258 | 8/1972 | Wolzak | 198/457 |
| 4,763,773 | 8/1988 | Kawarabashi et al. | 198/463.3 X |
| 5,009,306 | 4/1991 | Roderick et al. | 198/414 |

FOREIGN PATENT DOCUMENTS

| | | | |
|---|---|---|---|
| 2205153 | 8/1973 | Fed. Rep. of Germany | 198/414 |
| 3334977 | 5/1987 | Fed. Rep. of Germany . | |
| 3712378 | 10/1988 | Fed. Rep. of Germany . | |
| 3830194 | 3/1990 | Fed. Rep. of Germany | 198/457 |
| 0011564 | 1/1977 | Japan | 198/414 |

*Primary Examiner*—Robert P. Olszewski
*Assistant Examiner*—Cheryl L. Gastineau
*Attorney, Agent, or Firm*—Bell, Seltzer, Park & Gibson

[57] ABSTRACT

A package transport mechanism comprises a package carrier for receiving and supporting a package on its upper surface, and a lifting device carrying the package carrier on its upper end for upward and downward movement and for rotation about a vertical axis. The package carrier includes a package supporting device on its upper surface comprising a horizontally-extending endless conveyor and devices for selectively driving the endless conveyor in either direction, a base plate for movably carrying the supporting device, and devices mounting the supporting device on the base plate for pivoting movement about a horizontal axis arranged centric with the longitudinal center plane of and below the endless conveyor. The lifting device comprises a lifting column which defines the vertical axis of rotation.

3 Claims, 3 Drawing Sheets

PACKAGE TRANSPORT DEVICE

FIELD OF THE INVENTION

The present invention relates to a package transport mechanism of the type utilized for receiving, supporting and transporting packages, including doffed packages of processed textile thread, from one location to another location during handling thereof and which includes a package carrier having a supporting device for receiving and supporting a package on its upper surface, and a lifting device carrying said package carrier on the upper end thereof for upward and downward movement and for rotation about a vertical axis.

BACKGROUND OF THE INVENTION

In the normal case, packages are to be relocated from one place of production to a further production line. At the individual production places, the delivery point or the receiving point for the packages is not always located on one and the same level. As the case may be, it is also necessary to bridge entire stories of a building.

Transportation means which receive packages or bobbins are often of a different design and construction. Thus, it is possible to move the packages by means of a conveyor belt in the region of the one production place, whereas in the region of the next production place, it becomes necessary to transfer the same package, for example, to an overhead conveyor, to be further transported by the latter.

To bridge differences of height, use is made of so-called package lifters or package elevating mechanisms, such as are disclosed, for example in the German Patent 33 34 977 and German published Application OS 37 12 378, which also correspond to a device as defined in the preamble of the claim.

In the case of the package transport device disclosed in German OS 37 12 378, the actual package carrier comprises two parallel, spaced-apart roller trains, which advance the packages supported thereon by the action of gravity. The vertical axis, about which the actual package carrier can be rotated, is laterally located outside the actual package carrier. As a result the device requires a relatively large space in the horizontal direction.

The package transport device disclosed in German Patent 33 34 977 comprises a lifting mechanism in the form of a lifting column arranged substantially centric with the package carrier, which cooperates during its upward and downward movements with a lateral cam guide, so as to be able to rotate the lifting mechanism and thus the package carrier. The rotation of the package carrier therefore depends on a certain height position and the design and construction of the cam guide, so that as a result relatively narrow limits are set. The actual package supporting means consists of lateral carrying and supporting arms. In the region of the receiving point for packages, a conveyor in the form of driven belts is associated to the package transport system. These belts are operative exclusively in the region of the package receiving point. For the transfer of the packages from the transport device after having being moved upward, special receiving units are necessary, for example, in the form of mandrills or pins, which are adapted to enter into the tubes of the packages and arranged on an overhead conveyor. This known device does not permit, or makes it almost impossible, to convey the packages, for example, from a higher level to the region of a lower level, since the arrival of packages at a higher level does not ensure a reliable transfer of the package to the package transport device.

Further, both known package transport devices do not have the possibility of receiving the packages by the transport device safely from both sides of the transport device, since the two package transport devices are equipped with stops, which permit to receive packages at the receiving point only from one side.

OBJECT AND SUMMARY OF THE INVENTION

It is the object of the present invention to provide a package transport device, which is more diversified in its method of function and operation than the known devices of this type.

This object is accomplished in accordance with the present invention by providing a package transport mechanism comprising a package carrier for receiving and supporting a package on its upper surface, and a lifting device carrying said package carrier on the upper end thereof for upward and downward movement and for rotation about a vertical axis. The package carrier includes a supporting device for receiving and supporting the package on its upper surface and comprising a horizontally-extending endless conveyor and means for selectively driving said endless conveyor in either direction, a base plate for movably carrying said supporting device, and means mounting said supporting device on said base plate for pivoting movement about a horizontal axis arranged centric with the longitudinal center plane of and below said endless conveyor. The lifting device comprises a lifting column which defines the vertical axis of rotation Preferably, the endless conveyor is selected from the group consisting of an endless band, an endless chain or an endless belt. Said endless conveyor may also preferably comprise two laterally spaced-apart conveyor belts commonly driven by the drive means and having the horizontal axis of pivoting movement thereof located at equal distances from or between the conveyor belts and below the conveyor belts.

The package transport device of the present invention is characterized in essence by an active package supporting device, it being possible to transfer the packages from and to the package transport device at any height and in any rotated position of the transport device. To this end, the package carrier is equipped with its own endless conveyor, for example, a belt drive, so as to position individual packages or groups of packages in the region of the package carrier such that it is possible to perform further manipulations with or on the package or packages.

As a result of the endless conveyor in the form of, for example, two conveyor belts, one endless band, one endless belt or one endless chain, being able to operate selectively in the one or the other direction, it is possible to orient the packages received by the package carrier such that after the packages are transferred to a further processing place of production, the yarn is able to unwind in both directions (P or Q unwinding respectively).

BRIEF DESCRIPTION OF THE DRAWINGS

The package transport device of the present invention will be described below in greater detail with reference to the drawing, in which.

DETAILED DESCRIPTION OF PREFERRED EMBODIMENT OF THE INVENTION

Figure 1:
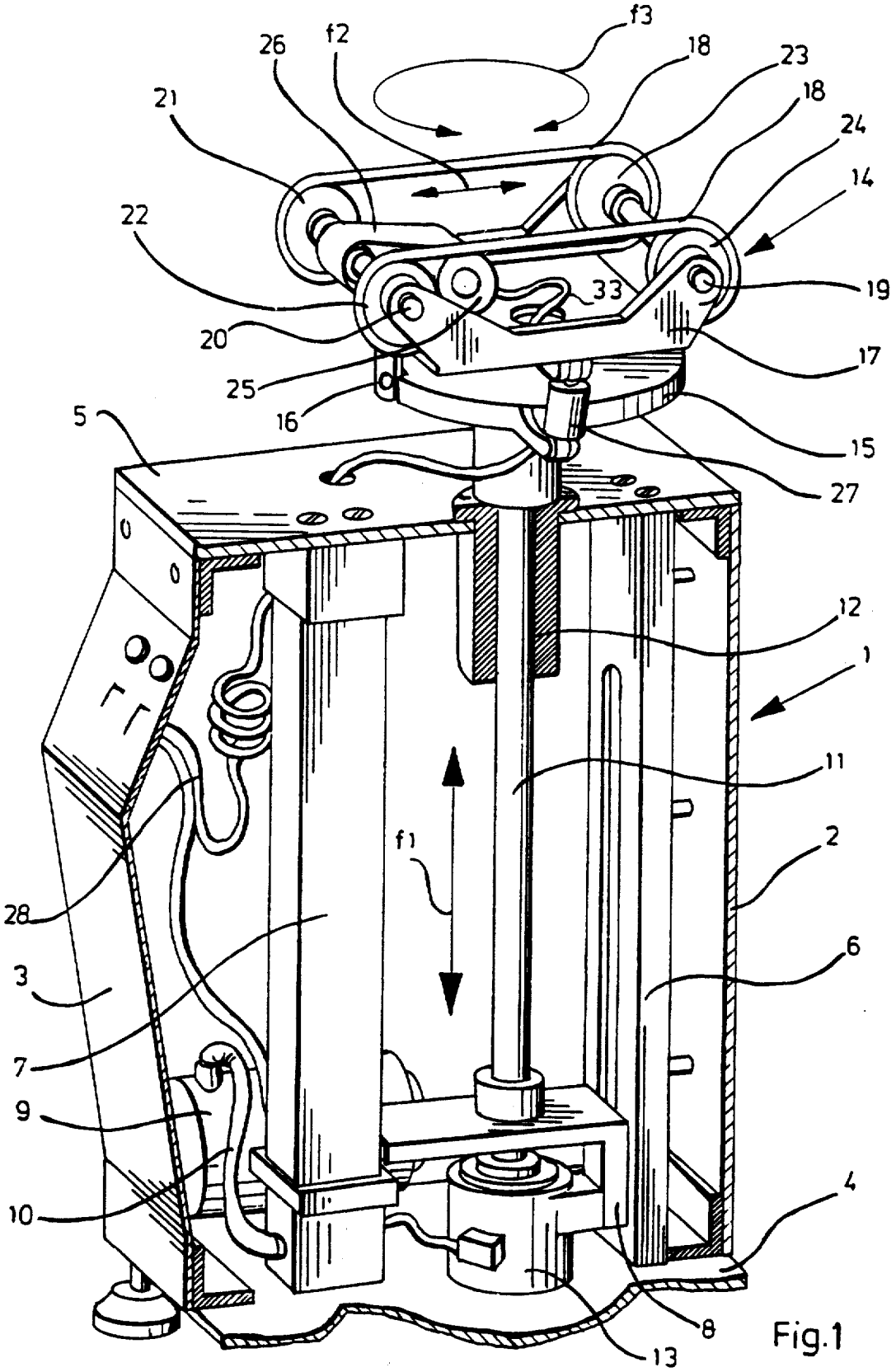
FIG. 1 is a side elevation view, partially cut, of the package transport device according to the present invention.

The package transport device of FIG. 1 comprises a frame 1 with two lateral frame parts 2 and 3, a base plate 4 and a top plate 5. Between the two plates 4 and 5, two guide pillars 6 and 7 extend with a lateral distance, which guide between them a lifting carriage 8. Accommodated in the guide pillar 7 is a drive mechanism (not shown), preferably a hydraulic or pneumatic motor, which is supplied with energy from a storage tank 9 via a line 10, so as to be able to move the lifting carriage 8 upward and downward in the direction of double arrow f1.

Mounted on the upper side of the lifting carriage 8 is a lifting column 11, which is guided in a sleeve 12 inserted into the top plate 5. Mounted on the underside of the lifting carriage 8 is a motor 13, preferably a pneumatic or hydraulic motor, which is operative in both directions of rotation and permits to rotate the lifting column 11 in both directions.

Attached to the end of the lifting column 11, which carries the upper plate 5, is the base plate 15 of the actual package carrier 14. Jointed to the base plate 15 is a package supporting device, which comprises an upwardly open, substantially U-shaped frame 17, which can be rotated about a horizontal shaft 16. The frame 17 accommodates roller bodies 21, 22, 23, 24 supported on shafts 19 and 20, over or about which conveyor belts 18 extend, which serve as endless conveyors. However, in the place of two conveyor belts, the endless conveyor can also comprise only one endless member in the form of an endless band, an endless belt or an endless chain.

Arranged on the base plate 15 is a further drive motor 25 for driving a belt 26, which permits to drive the shaft 20 selectively in the one or the other direction of rotation. The rollers 21 and 22 are fixedly connected with the shaft 20. The motor 25 is supplied with energy via a line 33.

For the purpose of tilting the frame 17 about the horizontal shaft 16, a lifting cylinder 27 is mounted between the base plate 15 and the frame 17, which receives energy via a line 28.

The double arrow f2 indicates that the conveyor belts 18 can be driven in both directions. The double arrow f3 shows that the package carrier 14 can be rotated by means of motor 13 in the one or the other direction.

Figure 2:
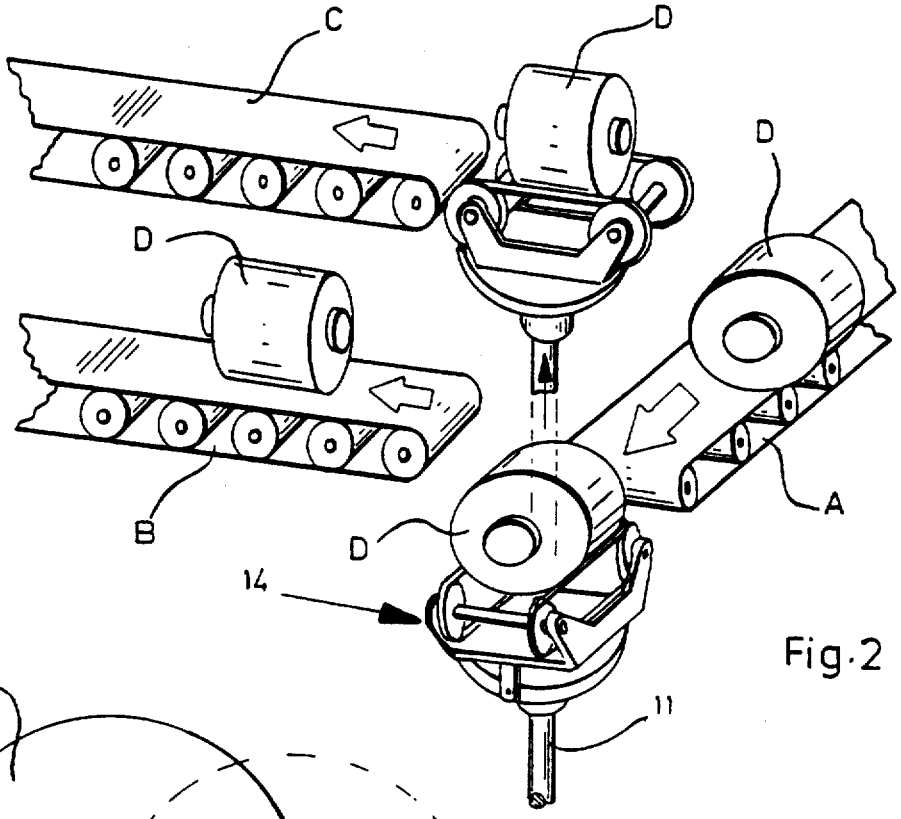
FIG. 2 is a schematic view of essentially the package carrier of the device of the present invention in its association with preceding and subsequent package conveyor belts.

FIG. 2 illustrates the association of the package transport device of the present invention, which is represented by the lifting column 11 and the package carrier 14, with a package delivery belt A with package advancing belts B and C, which are arranged at different heights relative to the first belt. Arrows associated to the belts A, B and C indicate that the belt A supplies the packages D, whereas the belts B and C further advance the packages. The package transport device of the present invention also permits to convey the packages in reversed direction, for example, such that the packages D are supplied by means of the belts B and C, and then further advanced by the belt A. Regardless of the other belt, each of the belts A, B and C can be a delivery belt or a further advancing belt.

The fact that the package transport device of the present invention permits to rotate the package carrier 14 to any desired position, and further the fact that the package carrier 14 serving as a direct support for the packages D includes an active conveyor belt drive, allows to receive and deliver the packages D at any height. With respect to the so-called P or the so-called Q unwinding of the yarns, it is possible to align or orient the packages D. FIG. 2 shows the package carrier 14 in two different heights.

Figure 3:
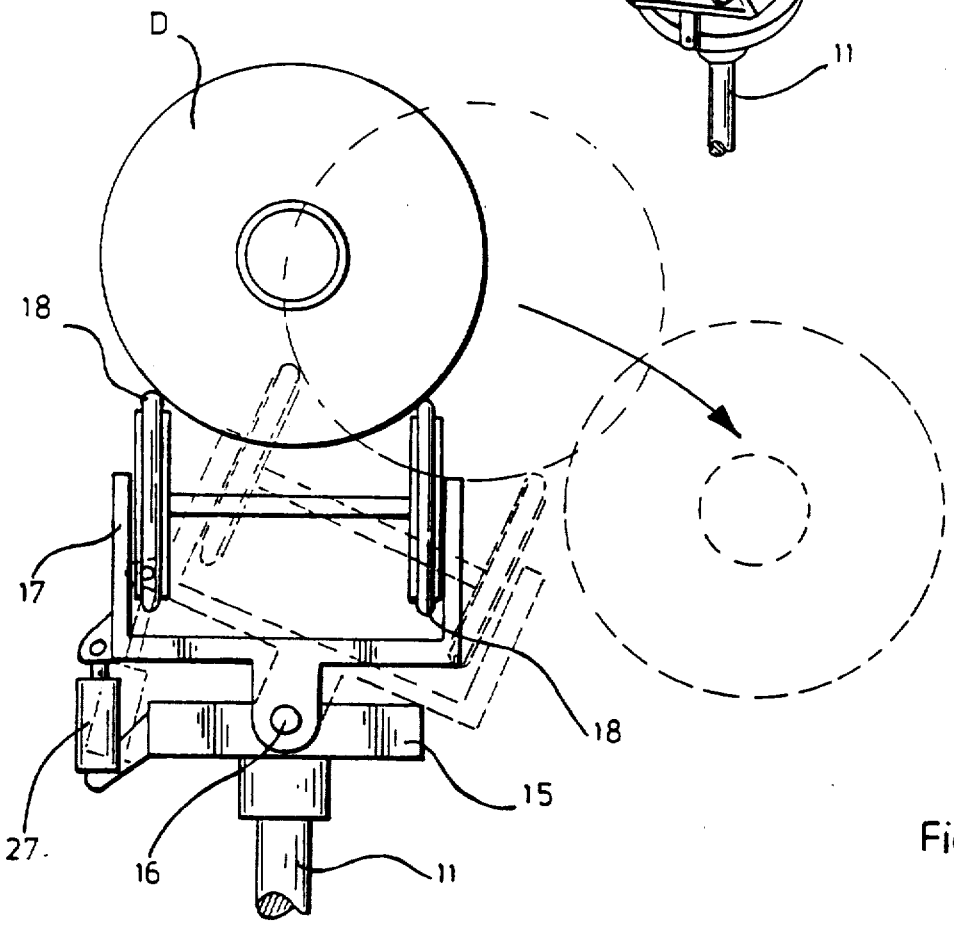
FIG. 3 is a schematic side elevation view of the package carrier in two different positions.

FIG. 3 shows in solid lines the frame 17 first in its original transporting position, and second in a position tilted about the horizontal shaft 16 (shown in dashed lines) with the lifting cylinder 27 moved out. In this tilted position shown in dashed lines, it its possible to unload the packages D sideways, for example, on a conveyor belt, which is destined for further transportation and not shown in more detail.

Figures 4, 5:
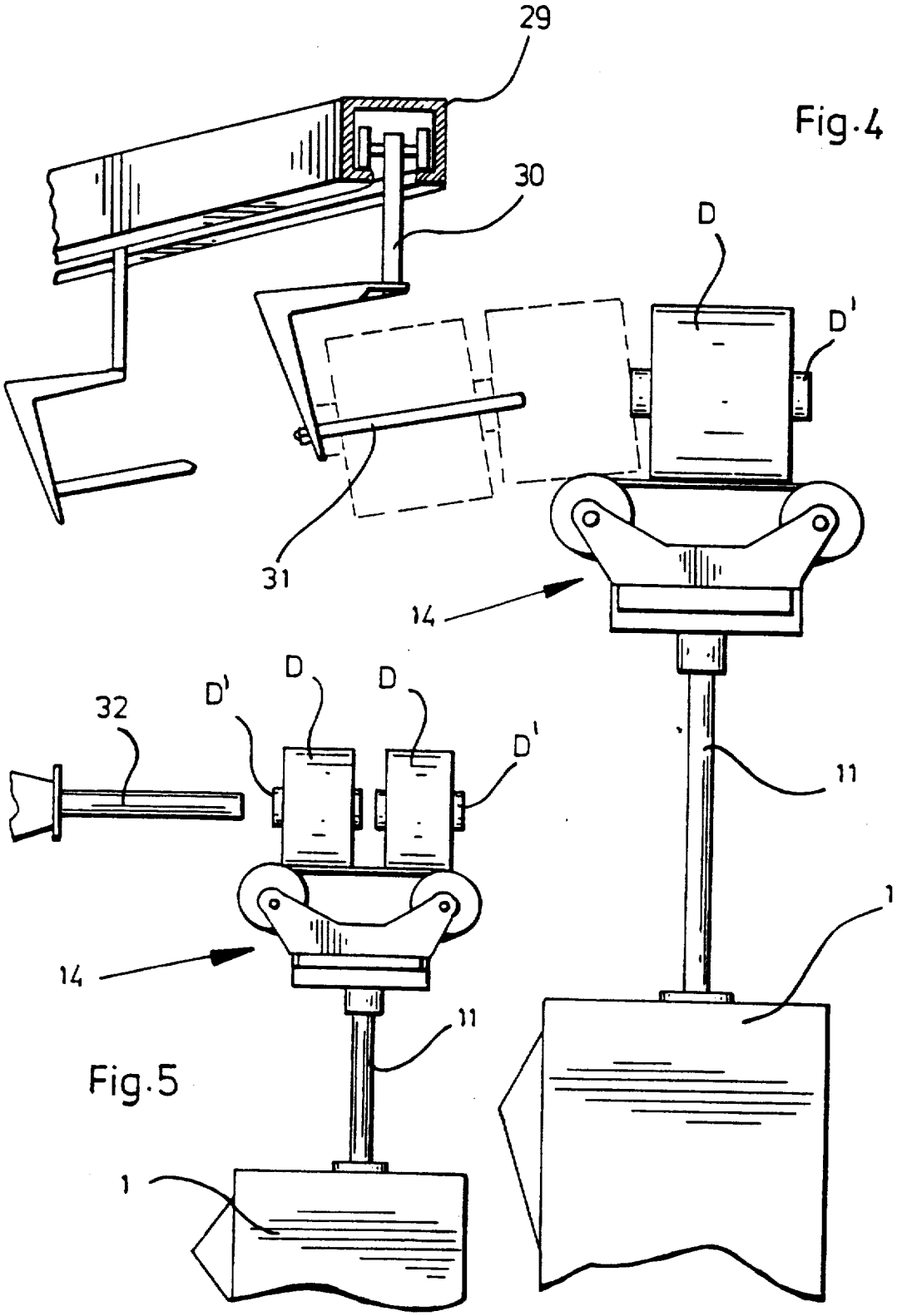
FIG. 4 is a view of the package transport device of the present invention in its association with a further transporting overhead conveyor.
FIG. 5 is a view of the package transport device of the present invention in its association with a modified embodiment of a further transporting conveyor.

FIG. 4 is a schematic view showing the association of the package transport device of the present invention to an overhead conveyor, which comprises a transport rail 29 and a package receiving means 30 traveling along the rail 29 and comprising a pin or mandril 31 adapted to enter into the package tube.

FIG. 5 shows the package transport device of the present invention, wherein the package carrier 14 is suitable for receiving two packages D at the same time. To remove the packages D from the package carrier 14, a mandril or pin 32 is provided, which is adapted to enter into the package tubes.

The package transport device of the present invention permits, for example, to bridge long distances between preceding and subsequent transport devices with the packages being aligned in a position-oriented manner, and to take also further measures, such as sorting, orienting and distributing the packages to a proper position in an material handling flow in general.

I claim:

1. A wound textile thread bobbin package handling and transport means for (1) receiving the bobbin package from a first conveying mechanism at one location, (2) transporting the bobbin package to a second conveying mechanism at another location and (3) conveying the bobbin package onto the second conveying mechanism in a selected longitudinal or transverse direction of said means; said handling and transport means comprising a package carrier having an upper surface for receiving and supporting the bobbin package thereon and comprising a horizontally extending endless conveyor, means for selectively driving said endless conveyor in either direction to convey the bobbin package therefrom in either longitudinal direction, and a base plate for mounting said endless conveyor;

means mounting said endless conveyor on said base plate for pivoting movement about a longitudinal center plane of and below said endless conveyor and means for selectively pivoting said endless conveyor about the horizontal axis to remove the bobbin package therefrom in the transverse direction; and lifting means carrying said package carrier on the upper end thereof for upward and downward movement and for rotation about a vertical axis and comprising a lifting column which defines the vertical axis of rotation.

2. A package transport mechanism, according to claim 1, in which said endless conveyor is selected from the group consisting of an endless band, an endless chain or an endless belt.

3. A package transport mechanism, according to claim 1, in which said endless conveyor comprises two laterally spaced-apart conveyor belts commonly driven by said drive means, and the horizontal axis of pivoting movement of said supporting device is located at equal distances from said conveyor belts below the latter.

* * * * *

UNITED STATES PATENT AND TRADEMARK OFFICE

CERTIFICATE OF CORRECTION

PATENT NO. : 5,141,095

DATED : August 25, 1992

INVENTOR(S) : Heinz Kamp

It is certified that error appears in the above-identified patent and that said Letters Patent is hereby corrected as shown below:

In the Inventor and Assignee (cover page), "Fed. Rep. Of Germany" should be -- Germany --.

Column 4, line 66, after "a" insert -- horizontal axis arranged concentric with the --.

Signed and Sealed this

Twenty-fifth Day of January, 1994

*Attest:*

*Attesting Officer*

Bruce Lehman

BRUCE LEHMAN

*Commissioner of Patents and Trademarks*